United States Patent [19]

Pekarek

[11] 4,339,838

[45] Jul. 20, 1982

[54] SQUEEGEE

[76] Inventor: Gerald P. Pekarek, 1112 67th St. NW., Bradenton, Fla. 33529

[21] Appl. No.: 208,310

[22] Filed: Nov. 19, 1980

[51] Int. Cl.[3] ..... A47L 1/06

[52] U.S. Cl. ..... 15/245; 15/185

[58] Field of Search ..... 15/184–185, 15/203, 236 R, 245

[56] References Cited

U.S. PATENT DOCUMENTS

| | | | |
|---|---|---|---|
| 1,201,076 | 10/1916 | Murray . | |
| 1,382,042 | 6/1921 | Wright . | |
| 1,949,671 | 3/1934 | Zerilli | 15/184 |
| 2,296,525 | 9/1942 | Johnson | 15/184 |
| 3,059,259 | 10/1962 | Peilet et al. | 15/184 |
| 3,765,049 | 10/1973 | Green et al. | 15/203 X |
| 3,950,813 | 4/1976 | Buck | 15/245 |
| 3,977,420 | 8/1976 | Yalof | 132/11 R |
| 4,001,910 | 1/1977 | Peilet | 15/184 |
| 4,062,083 | 12/1977 | McKay | 15/184 X |

FOREIGN PATENT DOCUMENTS

| | | | |
|---|---|---|---|
| 228663 | 7/1963 | Austria | 15/245 |
| 794594 | 5/1958 | United Kingdom | 15/184 |

*Primary Examiner*—Robert L. Bleutge

*Attorney, Agent, or Firm*—Benjamin P. Reese, II

[57] ABSTRACT

A squeegee having a retractable blade. One embodiment of the present invention provides a handless squeegee having a retractable blade. Alternate embodiments provide a squeegee having both a foldable handle and a retractable blade. With each of the embodiments, a blade holder and blade are moveably positioned in the interior of a blade housing. An elongated opening is provided through the upper surface of the blade housing for extending and retracting the blade. Mechanical means are provided for moving the blade holder in the interior of the blade housing when it is desired to either extend or retract the blade.

15 Claims, 11 Drawing Figures

SQUEEGEE

BACKGROUND OF THE INVENTION

This invention relates to a squeegee having a retractable blade.

The conventional squeegee is a device consisting of a handle having a blade of rubber or leather set transversely at one end for spreading, pushing or wiping liquids off or across a surface. The conventional squeegee is widely used for cleaning windows, mirrors, window-like doors and the like. Usually, the items which are cleaned with a squeegee are manufactured from transparent or translucent glass or plastic materials. The conventional squeegee is widely available in a variety of blade and handle lengths which are suitable for particular cleaning operations.

The conventional squeegee is satisfactory for most window, mirror and window-like door cleaning operations. But, the conventional squeegee, with its elongated, fixed handle, is a lanky, unattractive device which requires substantial space for storage between periods of use. For many light cleaning operations, such as bathroom mirrors, shower doors and automobile windows, a squeegee having a more compact configuration and a more attractive appearance than is inherent with a conventional squeegee is desirable. A squeegee having a more compact configuration could be stored in a medicine cabinet or a vanity drawer of a bathroom or in a glove compartment of an automobile between periods of use. And, a squeegee having both a more compact configuration and a more attractive appearance would be suitable for use as a bathroom accessory which is stored on an open shelf or a vanity top or suspended from a suitable location on the wall on in the shower between periods of use.

Either a handleless squeegee or a squeegee having a foldable handle would be more compact than a squeegee having a conventional fixed handle. Furthermore, either a handleless squeegee or a squeegee having a foldable handle are likely to be more attractive than a squeegee having a conventional fixed handle. And, if either a handleless squeegee or a squeegee having a foldable handle are provided with a retractable blade, the resulting squeegee will be still more compact and attractive than a conventional squeegee. Finally, if either a handleless squeegee or a squeegee having a foldable handle are provided with a retractable blade which is concealed from view in its retracted position, the resulting squeegee is likely to be as compact and attractive as is reasonably possible for such a device. The prior art does not provide a squeegee having the above described characteristics.

OBJECTS OF THE INVENTION

The primary object of this invention is to provide a squeegee having a retractable blade. A further object of this invention is to provide a handleless squeegee having a retractable blade. Another object of this invention is to provide a squeegee having both a foldable handle and a retractable blade. Yet another object of this invention is to provide either a handleless squeegee having a retractable blade which is concealed from view in its retracted position or a squeegee having both a foldable handle and a retractable blade which is concealed from view in its retracted position. A final object of this invention is to provide a squeegee having a compact configuration and an attractive appearance.

SUMMARY OF THE INVENTION

The present invention provides a squeegee having a retractable blade which is concealed from view in its retracted position. One embodiment of the present invention provides a handleless squeegee having a retractable blade. Two alternate embodiments provide a squeegee having both a foldable handle and a retractable blade. All of the embodiments provide a squeegee having a compact configuration and an attractive appearance.

In one embodiment, the squeegee of the present invention comprises an essentially rectangular blade housing having a blade holder moveably positioned in its interior and a pair of handle elements pivotedly attached to its interior sides. Each of the handle elements has a yoke for embracing the blade holder. With each handle element, a pair of axially aligned cylindrical protrusions engage an essentially rectangular, horizontal opening through the blade holder for movement of the blade holder upward and downward in the interior of the blade housing in response to movement of the handle element. The blade housing has an opening through its upper surface which permits vertical movement of the blade into and out of the blade housing in response to movement of the blade holder in the interior of the blade housing.

In an alternate embodiment, the squeegee of the present invention comprises an essentially rectangular blade housing having a blade holder moveably positioned in its interior and a pair of handle elements pivotedly attached to its exterior sides. Each of the handle elements has a yoke for embracing the exterior of the blade housing. A spur gear and rack mechanism is provided for movement of the blade holder upward and downward in the interior of the blade housing in response to movement of each handle element. An opening through the upper surace of the blade housing is provided for movement of the blade into and out of the blade housing as the blade holder moves in the interior of the blade housing.

In yet another embodiment, the squeegee of the present invention comprises an essentially rectangular blade housing having a blade holder moveably positioned in its interior and springs for biasing the blade holder upward. The blade housing has an opening through its upper surface which permits vertical movement of the blade into and out of the blade housing in response to movement of the blade holder in the interior of the blade housing. A lever is provided on each end of the blade holder for movement of the blade holder and the blade into a retracted position. A hold-down arm and latch mechanism maintains the blade holder in its retracted position for storage of the squeegee between periods of use. In this embodiment, the squeegee is handleless.

DETAILED DESCRIPTION OF THE PREFERRED EMBODIMENTS

Figure 1:
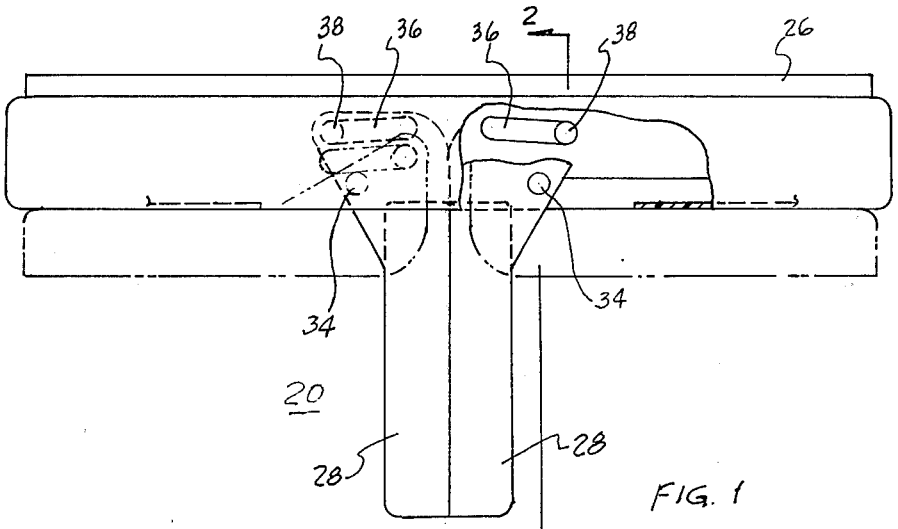
FIG. 1 is a side elevational view of one embodiment of a squeegee having a foldable handle and a retractable blade with a portion of one of its handle elements and a portion of its blade housing removed to illustrate the mechanism provided for folding its handle and retracting its blade.
Figure 2:
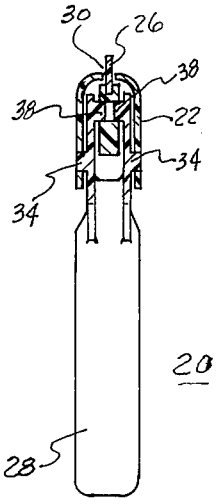
FIG. 2 is a cross-sectional view taken along line 2—2 in FIG. 1, and further illustrating the spatial relationship between the blade housing, the foldable handle and the retractable blade of the embodiment illustrated in FIG. 1.
Figure 3:
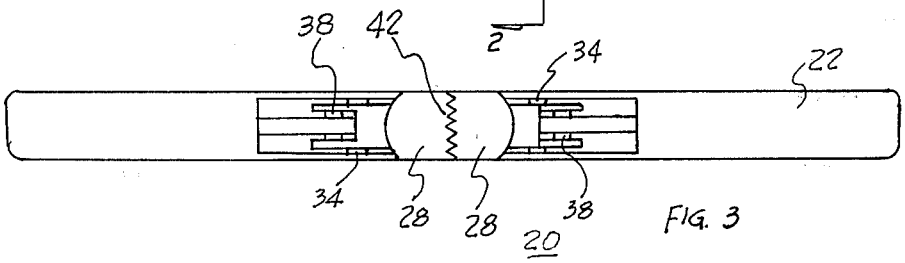
FIG. 3 is a bottom view of the embodiment illustrated in FIG. 1, and illustrating the interlocking relationship of the handle elements in their extended position.
Figure 4:
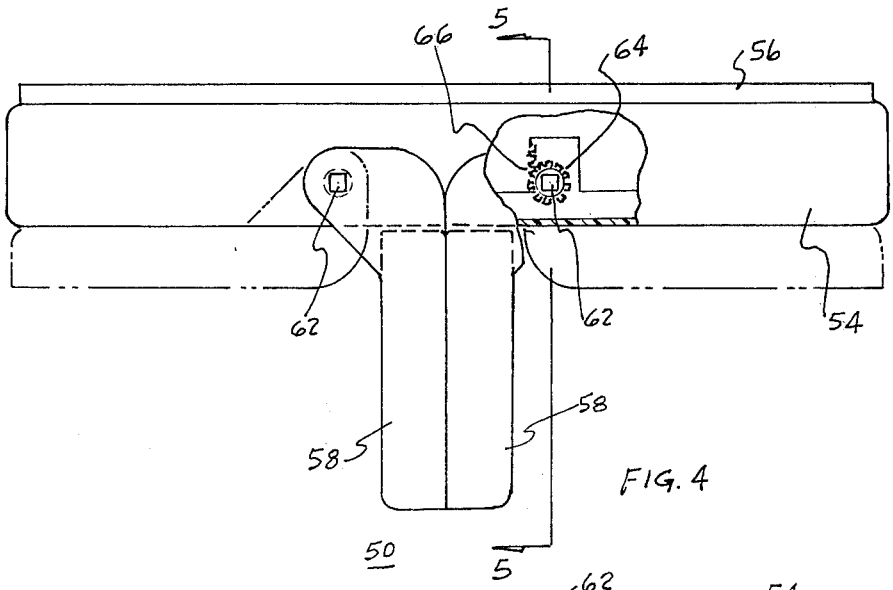
FIG. 4 is a side elevational view of an alternate embodiment of a squeegee having a foldable handle and a retractable blade with a portion of one of its handle elements and a portion of its blade housing removed to illustrate the mechanism provided for folding its handle and retracting its blade.
Figure 5:
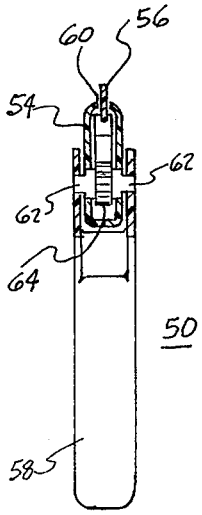
FIG. 5 is a cross-sectional view taken along line 5—5 in FIG. 4, and further illustrating the spatial relationship between the blade housing, the foldable handle and the retractable blade of the embodiment illustrated in FIG. 4.
Figure 6:
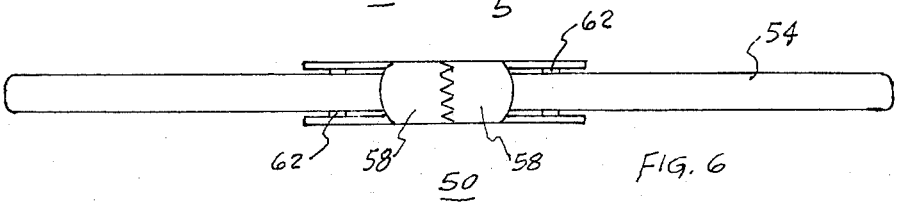
FIG. 6 is a bottom view of the embodiment illustrated in FIG. 4. and illustrating the interlocking relationship of the handle elements in their extended position.

The preferred embodiments of the squeegee of the present invention are illustrated in FIGS. 1–11. FIGS. 1–3 illustrate one embodiment of a squeegee having a foldable handle and a retractable blade. FIGS. 4–6 illustrate an alternate embodiment of a squeegee having a foldable handle and a retractable blade. A handleless squeegee having a retractable blade is illustrated in FIGS. 7–11.

Referring to FIGS. 1–3, the squeegee which is illustrated is designated generally by the reference numeral 20. The squeegee 20 consists essentially of an elongated blade housing 22, an elongated blade holder 24, an elongated blade 26 and a pair of elongated handle elements 28. The blade housing 22 which is illustrated is an essentially rectangular, hollow body having its height dimension greater than its width dimension and having the blade holder 24 moveably positioned in its interior. The blade housing 22 has an elongated rectangular opening 30 through its upper surface which permits vertical movement of the blade 26 into and out of the blade housing 22 and an elongated rectangular opening 32 through its lower surface.

The upper portion of each of the handle elements 28 comprises a yoke for embracing the blade holder 24 moveably positioned in the interior of the blade housing 22. The upper portion of each of said handle elements 28 is passed through the rectangular opening 32 and pivotedly attached to the interior of the blade housing 22 by conventional means, such as a pair of axially aligned pivot pins 34 which engage axially aligned cylindrical openings in the parallel sides of the blade housing 22. Preferably, each pivot pin 34 is a cylindrical protrusion on one of the parallel arms of the upper portion of the handle element 28. The blade holder 24 has a pair of essentially rectangular, horizontal openings 36 through its body. One of said openings 36 is located between the parallel arms of the upper portion of one of the handle elements 28 and the other of said openings 36 is located between the parallel arms of the upper portion of the other of said handle elements 28. Each of the parallel arms of the upper portion of each handle element 28 has a cylindrical protrusion 38 which extends into and engages the horizontal opening 36 which is located adjacent to the particular arm. In this manner, each pair of axially aligned cylindrical protrusions 38 forms a lift pin for vertical movement of the blade holder 24 when the handle element 28 is pivoted.

It will be readily appreciated that the structure which has been described and illustrated provides a squeegee 20 having both a foldable handle and a retractable blade. Referring particularly to FIG. 3, the handle elements 28 have opposed surfaces 42 which interlock to form a single handle when the handle elements 28 are extended for use. When it is desired to store the squeegee 20 between periods of use, the handle elements 28 are pivoted apart and upward until they are adjacent to and parallel to the bottom of the blade housing 22. As the handle elements 28 are pivoted, the cylindrical protrusions 38 positioned in the horizontal openings 36 move the blade holder 24 downward in the interior of the blade housing 22, and, thereby, retract the blade 26 into the interior of the blade housing 22. And, when it is desired to use the squeegee 20, the handle elements 28 are pivoted downward and together into their interlocked position to form a single handle. As the handle elements 28 are pivoted, the cylindrical protrusions 38 positioned in the horizontal openings 36 move the blade holder 24 upward in the interior of the blade housing 22, and, thereby, extend the blade 26 for use.

Referring to FIGS. 4–6, the squeegee which is illustrated is designated generally by the reference numeral 50. The squeegee 50 consists essentially of an elongated blade housing 52, an elongated blade holder 54, an elongated blade 56 and a pair of elongated handle elements 58. The blade housing 52 whch is illustrated is an essentially rectangular, hollow body having its height dimension greater than its width dimension and having the blade holder 54 moveably positioned in its interior. The blade housing 52 has an elongated rectangular opening 60 through its upper surface which permits vertical movement of the blade 56 into and out of the blade housing 52.

The upper portion of each of the handle elements 58 comprises a yoke for embracing the exterior of the blade housing 52. And, the upper portion of each of said handle elements 58 is pivotedly attached to the parallel sides of the blade housing 52 by conventional means, such as a pivot pin 62 which passes through axially aligned cylindrical openings in the parallel sides of the blade housing 52 and fixedly engages the parallel arms of the upper portion of the handle element 58. A spur gear 64 is fixedly mounted on the pivot pin 62 by conventional means. Preferably, this is achieved by forming the pivot pin 62 and the spur gear 64 as a single element. The teeth of the spur gear 64 engage the teeth of a vertical rack 66 which is provided on the blade holder 54.

It will be readily appreciated that the structure which has been described and illustrated provides a squeegee 50 having both a foldable handle and a retractable blade. Referring particularly to FIG. 4, the handle elements 58 have opposed surfaces 68 which interlock to form a single handle when the handle elements 58 are extended for use. When it is desired to store the squeegee 50 between periods of use, the handle elements 58 are pivoted apart and upward until they are adjacent to and parallel to the bottom of the blade housing 52. As the handle elements 58 are pivoted, the spur gear 64 which is fixedly mounted on the pivot pin 62 rotates to move the rack 66 and blade holder 54 downward in the interior of the blade housing 52, and, thereby, retract the blade 56 into the interior of the blade housing 52. And, when it is desired to use the squeegee 50, the handle elements 58 are pivoted downward and together into their interlocked position to form a single handle. As the handle elements 58 are pivoted, the spur gear 64 rotates to move the rack 66 and blade holder 54 upward in the interior of the blade housing 52, and, thereby, extend the blade 56 for use.

Referring to FIGS. 7–11, the squeegee which is illustrated is designated generally by the reference numeral 80. The squeegee 80 consists essentially of an elongated blade housing 82, an elongated blade holder 84, an elongated blade 86, a pair of springs 88 and a hold-down arm 90. The blade housing 82 which is illustrated is an essentially rectangular, hollow body having its height dimension greater than its width dimension and having the blade holder 84 moveably positioned in its interior. The blade housing 82 has an elongated rectangular opening 92 through its upper surface which permits vertical movement of the blade 86 into and out of the blade housing 82.

The springs 88 are positioned in the interior of the blade housing 82 to bias the blade holder 84 upward with the blade 86 extended for use. Preferably, each spring 88 is a leaf spring which is held in position by a pair of retaining pins 94. A lever 96 is provided on each end of the blade holder 84. Each of the levers 96 is moveably positioned in and through an essentially rectangular opening 98 through the end of the blade housing 82. The hold-down arm 90 is pivotedly mounted in the interior of the blade housing 82 by conventional means, such as pivot pin 100. The lower end of the hold-down arm 90 is configured to form a push release bar 102 which is moveably positioned in and through an essentially rectangular opening 104 through one side of the blade housing 82. The upper end of the hold-down arm 90 is configured to form a latch element 106 for engaging an appropriately configured notch 108 in one side of the blade holder 84. A spring 110 is provided to bias the latch element 106 of the hold-down arm 90 in the direction of the notch 108 in the blade holder 82. Preferably, the spring 110 is a whisker-like protrusion on the upper end of the hold-down arm 90.

Figure 7:
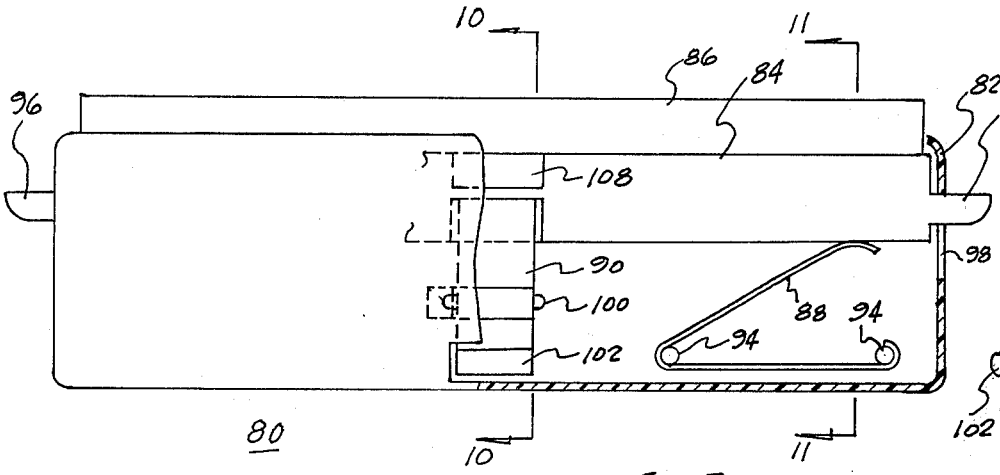
FIG. 7 is a side elevational view of one embodiment of a handleless squeegee having a retractable blade with a portion of its blade housing removed to illustrate the mechanism provided for retracting its blade.
Figure 8:
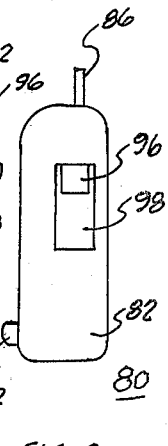
FIG. 8 is an end view of the embodiment illustrated in FIG. 7.
Figure 9:
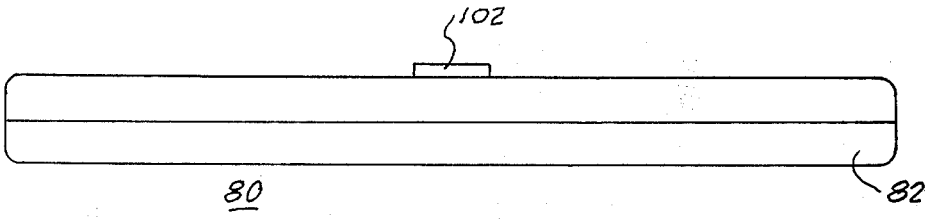
FIG. 9 is a bottom view of the embodiment illustrated in FIG. 7.
Figure 10:
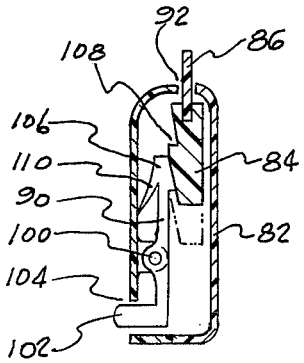
FIG. 10 is a cross-sectional view taken along line 10—10 in FIG. 7, and illustrating the latch mechanism for holding the blade in its retracted position.
Figure 11:
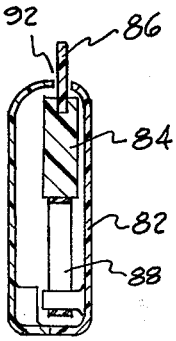
FIG. 11 is a cross-sectional view taken along line 11—11 in FIG. 7, and further illustrating one of the leaf springs provided to bias the blade in its extended position.

It will be readily appreciated that the structure which has been described and illustrated provides a handleless squeegee 80 having a retractable blade. Referring particularly to FIGS. 7 and 10, the springs 88 bias the blade holder 84 upward with the blade 86 extended for use. When it is desired to store the squeegee 80 between periods of use, the levers 96 are moved downward to retract the blade 86. As the levers 96 are moved downward, the blade holder 84 compresses the springs 88 until the latch element 106 of the hold-down arm 90 is aligned with the notch 108 in the blade holder 84. When the latch element 106 and the notch 108 are aligned, the spring 110 extends, and, thereby, forces the latch element 106 into the notch 108 to hold the blade holder 84 and blade 86 in a retracted position. When it is desired to use the squeegee 80, the push bar 102 on the lower end of the hold-down arm 90 is pressed to simultaneously compress the spring 110 and disengage the latch element 106 from the notch 108. This permits the springs 88 to extend and move the blade holder 84 upward in the interior of the blade housing 82, and, thereby, extend the blade 86 for use.

Preferably, all major components, except the blade, of the squeegees 20 and 50 which have been described and illustrated are cast or molded from a suitable plastic material. For the squeegee 80, preferably, all major components, except the blade, springs and hold-down arm, are cast or molded from a suitable plastic material. The preferred material for the blade of the squeegees 20, 50 and 80 is soft rubber. For the squeegee 80, the preferred material for the springs is a suitable steel and the preferred material for the hold-down arm is a suitable nylon. The present invention is not limited, however, by either the materials used to fabricate the various components or the methods used for such fabrication.

While the present invention has been disclosed in connection with its preferred embodiments, there may be other embodiments which fall within the scope and spirit of the invention as defined by the claims.

I claim:

1. A squeegee, comprising:

(a) an elongated blade housing having an elongated retangular opening through its upper surface;

(b) an elongated blade holder moveably positioned in the interior of said blade housing;

(c) an elongated blade held by said blade holder for vertical movement through said opening in said blade housing;

(d) means for vertically moving said blade holder and said blade;

(e) means for securing said blade holder and said blade in their uppermost positions; and (f) means for securing said blade holder and said blade in their lowermost positions.

2. A squeegee as recited in claim 1, further comprising a handle element pivotedly attached to said blade housing.

3. A squeegee as recited in claim 1, further comprising a pair of handle elements, each of said handle elements being pivotedly attached to said blade housing.

4. A squeegee as recited in claims 1, 2 or 3, wherein said elongated blade housing, said elongated rectangular opening, said elongated blade holder and said elongated blade have parallel longitudinal axes.

5. A squeegee, comprising:

(a) an elongated blade housing having an elongated retangular opening through its upper surface and an elongated rectangular opening through its lower surface;

(b) an elongated blade holder moveably positioned in the interior of said blade housing;

(c) an elongated blade held by said blade holder for vertical movement through said opening in said upper surface of said blade housing;

(d) a handle element passing through said opening in said lower surface of said blade housing and pivotedly attached to the interior of said blade housing; and (e) means for operatively connecting said blade holder and said handle element such that said blade holder and said blade are moved vertically when said handle element is pivoted.

6. A squeegee as recited in claim 5, wherein said means for operatively connecting said blade holder and said handle element comprises an essentially rectangular, horizontal opening through said blade holder and a cylindrical protrusion on the uppermost portion of said handle element which engages said opening.

7. A squeegee as recited in claim 5, further comprising a second handle element passing through said opening in said lower surface of said blade housing and pivotedly attached to the interior of said blade housing and means for operatively connecting said blade holder and said second handle element such that said blade holder and said blade are moved vertically when both of said handle elements are pivoted.

8. A squeegee as recited in claim 7, wherein said means for operatively connecting said blade holder and said handle elements comprise a pair of essentially rectangular, horizontal openings through said blade holder and a cylindrical protrusion on the uppermost portion of each of said handle elements, each of said protrusions engaging one of said openings.

9. A squeegee, comprising:

(a) an elongated blade housing having an elongated rectangular opening through its upper surface;

(b) an elongated blade holder moveably positioned in the interior of said blade housing;

(c) an elongated blade held by said blade holder for vertical movement through said opening in said upper surface of said blade housing;

(d) a handle element pivotedly attached to the exterior of said blade housing; and (e) means for operatively connecting said blade holder and said handle element such that said blade holder and said blade are moved vertically when said handle element is pivoted.

10. A squeegee as recited in claim 9, wherein said means for operatively connecting said blade holder and said handle element comprises a vertical rack on said blade holder and a pivot pin having a spur gear fixedly mounted thereon, said pivot pin being fixedly attached to said handle element and moveably positioned in a cylindrical opening through said blade housing such that the teeth of said spur gear engage the teeth of said vertical rack.

11. A squeegee as recited in claim 9, further comprising a second handle element pivotedly attached to the exterior of said blade housing and means for operatively connecting said blade holder and said second handle element such that said blade holder and said blade are moved vertically when both of said handle elements are pivoted.

12. A squeegee as recited in claim 11, wherein said means for operatively connecting said blade holder and said handle elements comprise a pair of vertical racks and a pair of pivot pins, each of said pivot pins having a spur gear fixedly mounted thereon and each of said pivot pins being fixedly attached to one of said handle elements and moveably positioned in a cylindrical opening through said blade housing such that its teeth engage the teeth of one of said vertical racks.

13. A squeegee, comprising:

(a) an elongated blade housing having an elongated rectangular opening through its upper surface, an opening through each of its end surfaces, and an opening through one of its side surfaces;

(b) an elongated blade holder moveably positioned in the interior of said blade housing, said blade holder having a lever on each of its ends which is moveably positioned in one of said openings in one of said end surfaces of said blade housing;

(c) an elongated blade held by said blade holder for vertical movement through said opening in said upper surface of said blade housing;

(d) means for biasing said blade holder upward with said blade extended through said opening in said upper surface of said blade housing;

(e) a hold-down arm pivotedly mounted in the interior of said blade housing of said hold-down arm having a push release bar on its lower end which is moveably positioned in said opening through said side surface of said blade housing and a latch element on its upper end which engages a notch in one side of said blade holder; and (f) means for biasing said latch element of said hold-down arm in the direction of said notch in said blade holder.

14. A squeegee as recited in claim 13, wherein said means for biasing said blade holder upward comprises a spring.

15. A squeegee as recited in claim 13, wherein said means for biasing said latch element of said hold-down arm in the direction of said notch comprises a whisker-like protrusion on the upper end of said hold-down arm.

* * * * *